US007065833B2

(12) United States Patent
Kropf

(10) Patent No.: US 7,065,833 B2
(45) Date of Patent: Jun. 27, 2006

(54) FURNITURE HINGE WITH AUTOMATIC OPENING CONTROL MECHANISM

(75) Inventor: Peter Kropf, Hard (AT)

(73) Assignee: Grass GmbH, Hochst/Voralberg (AT)

( * ) Notice: Subject to any disclaimer, the term of this patent is extended or adjusted under 35 U.S.C. 154(b) by 80 days.

(21) Appl. No.: 10/890,288

(22) Filed: Jul. 13, 2004

(65) Prior Publication Data

US 2005/0015927 A1 Jan. 27, 2005

(30) Foreign Application Priority Data

Jul. 24, 2003 (DE) ..... 103 33 925

(51) Int. Cl.
*E05F 1/08* (2006.01)

(52) U.S. Cl. ..... 16/286; 16/294

(58) Field of Classification Search ..... 16/286, 16/287, 288, 303, 304, 291, 296, 297, 294
See application file for complete search history.

(56) References Cited

U.S. PATENT DOCUMENTS

| | | | | |
|---|---|---|---|---|
| 2,940,116 | A * | 6/1960 | Salice | 16/291 |
| 3,362,042 | A * | 1/1968 | Salice | 16/278 |
| 4,083,082 | A * | 4/1978 | Holmes | 16/288 |
| 4,236,272 | A * | 12/1980 | Gronbach et al. | 16/288 |
| 4,247,965 | A * | 2/1981 | Lautenschlager | 16/294 |
| 4,251,900 | A * | 2/1981 | Lautenschlager | 16/294 |
| 4,310,948 | A * | 1/1982 | Rock et al. | 16/335 |
| 4,352,222 | A * | 10/1982 | Mages et al. | 16/287 |

(Continued)

FOREIGN PATENT DOCUMENTS

DE 2818735 A * 11/1979

(Continued)

*Primary Examiner*—Chuck Y. Mah
(74) *Attorney, Agent, or Firm*—John M. Harrington; Kilpatrick Stockton LLP

(57) ABSTRACT

The invention concerns a cabinet hinge with an automatic opening device, especially for cabinet doors with a hinge cup, which is connected with a hinge to a hinge arm, which is, being adjustable and lockable, connected to a base plate, which is connected to a cabinet body; whereby, the hinge includes an inner and outer joint lever, which are fastened to the hinge cup, as well as the hinge arm, with each one pivoting joint pin, which causes a kind of parallelogram-joint to be formed between the hinge cup and the hinge arm, by which means the cabinet door relative to the cabinet body can be swung out; whereby, at least one elastic resilient spring element directly affects at least one joint pin of outer and/or inner joint lever and causes a torque for opening of the cabinet door from the closed position through a defined opening-angle area, and; whereby, the resilient spring element is fastened to the hinge cup, whereby, at least one resilient spring element affects through a sliding wedge directly or indirectly at least one join pin of the outer and/or inner joint lever. Specifically, the spring element is contained totally inside the hinge cup and includes at least one one-step piston rod-cylinder unit, which allows a relative movement of the sliding wedge towards the hinge cup and its top part during the opening process of the door by means of a spring and during the closing process by means of the strength of the user. The advantage of the spring element position on or in the hinge cup is that considerably more room is available for a heavy spring and heavy doors can be equipped with the automatic opening device, according to the invention.

13 Claims, 3 Drawing Sheets

U.S. PATENT DOCUMENTS

| | | | | | |
|---|---|---|---|---|---|
| 4,422,214 | A | * | 12/1983 | Lautenschlager et al. | 16/291 |
| 4,439,888 | A | * | 4/1984 | Merillat | 16/286 |
| 4,596,062 | A | * | 6/1986 | Rock | 16/304 |
| 5,500,983 | A | * | 3/1996 | Lautenschlager | 16/304 |
| 6,243,918 | B1 | * | 6/2001 | Zetti | 16/298 |

FOREIGN PATENT DOCUMENTS

| | | | | |
|---|---|---|---|---|
| DE | 2947153 | A | * | 6/1981 |
| DE | 101 52 699 | A1 | | 4/2003 |
| JP | 2004052401 | A | * | 2/2004 |
| SU | 1689576 | A1 | * | 11/1991 |

* cited by examiner

FURNITURE HINGE WITH AUTOMATIC OPENING CONTROL MECHANISM

FIELD OF THE INVENTION

The invention concerns a cabinet hinge with an automatic opening device, especially for cabinet door.

BACKGROUND OF THE INVENTION

In the current state of technology, numerous hinges of this type are well known and are used especially for cabinet doors, which close a cabinet, where the hinge is located between the door and the cabinet.

The cabinet door contains a space for a hinge cup, which is connected with a hinge to a hinge arm.

The connecting hinge between the hinge cup and the hinge arm contains an inside and an outside joint lever, each being pivotally fastened with a joint pin to the hinge cup, as well as to the hinge arm. Due to this, a kind of parallelogram-joint is formed between the hinge cup and the hinge arm, which allows the cabinet door to be moved away from the cabinet, as well as back to the cabinet, in a reliable manner.

In addition, the current state of technology also knows of a cabinet hinge with an automatic opening device (for example, DE 101 52 699 A1), which has a pressure opening in the closed position. The cabinet hinge shown there has at least one elastic moveable spring element, which is fastened to the hinge arm, and impacts directly or indirectly at least one joint pin of the outer and/or inner joint lever and, therefore, affects a torque to open the cabinet door from the closed position by a defined opening angle area. Preferably, a specially formed leg or compound spring is designed inside the hinge between the base plate and the hinge arm, which braces itself on the hinge arm and impacts a lever arm on the joint pin of the outer joint lever. A fastening feature of the spring element to the hinge cup is visible as well, but is not described in detail.

The disadvantage of the cabinet hinge with an automatic opening device shown in DE 101 52 699 A1, is that there is very little room for a suitable spring in the area of the hinge cup, hinge arm and hinge, which prevents the use of a robust spring. Another problem is to obtain the correct dimensions in the spring.

SUMMARY OF THE INVENTION

The purpose of this application is to design and develop a hinge, especially a cabinet hinge with an automatic opening device of the kind described above, in a way that sufficiently high opening strength is placed from the closed position onto the cabinet door through a defined opening-angle area. Furthermore, most building components of conventional cabinet hinges should be utilized. Another objective is to keep open the possibility of outfitting the hinge with either an automatic opening device or a dampening element.

The task is solved with a cabinet hinge with an automatic opening device.

The essential characteristic is that the spring element that provides the opening strength is fastened to the hinge cup and impacts through at least one moveable wedge at least one joint pin of the outer or inner joint lever directly or indirectly, and results in a torque for opening the cabinet door from the closed position by a defined opening-angle area.

The advantage is that the invention-related hinge causes opening pressure on the door from the closed position, so that, especially, when no door knobs or pulls are present (for visual reasons) and the generally known Touch-Latch or Push-Lock catch systems are used, a simple automatic opening within a large angle is made possible by disengaging the door, even though the door may be heavy.

In a preferred type of the embodiment, the spring element is totally or at least partially located on the inside of the hinge cup. However, in another type, the spring element may be outside of the hinge cup interior and be directly or indirectly connected to the same. The layout of the spring element in the interior of the hinge cup has the advantage of saving room, while at the same time protecting the spring element from damage and the user from injury. A large hinge cup in the form of the spring element is especially preferred.

In a preferred design, the spring element in the closed position is pre-stressed to the door and delivers its energy at least to the door, after the door is disengaged from the cabinet. In another type, the pre-stressing of the spring element can only be achieved through movement (e.g. pressure) of the door by the user. It is important that an opening torque activates by a predefined opening angle area of the cabinet door from the closed position of the cabinet door. Through this, the torque can be raised considerably, in order to produce sufficient opening pressure from the closed position. Prior to opening the door, however, the locking mechanism (Touch-Latch or Push-Lock) must be unlocked, so that the torque moment produced by the spring element can work freely and open the door to a predefined angle. The unlocking of the lock mechanism should preferably happen by applying pressure to the door in the direction of the cabinet, but can happen in other ways too, as for example, by easy touch, IR-remote control, timer, etc.

The predefined angle area for the opening of the door is determined so that after the door opens, one or more fingers can fit at least partially behind the door in the gap between the cabinet and door, and therefore, the door can be opened totally by hand. This has the advantage that a visually annoying knob on the door is not needed.

A spring element has to be planned for, which, after using the "Touch-Latch" or "Push-Lock" devices that "unlock" the door at closing, free the locking device through another push, for example, 10° (push pen principle). That means that in contrast to standard hinges, which have an automatic closing device through a built-in spring, this hinge should have opening strength, at least in the first 3° of the opening movement. Preferably, the hinge element has sleeve or case formed unit with a pressure spring, a guide element and a sliding wedge.

It is provided that the sliding wedge and the hinge cup have gliding surfaces facing each other.

The following describes the invention at hand more precisely by embodiments; however, these are only examples and should not be understood in a limiting manner.

DETAILED DESCRIPTION

Figure 1:
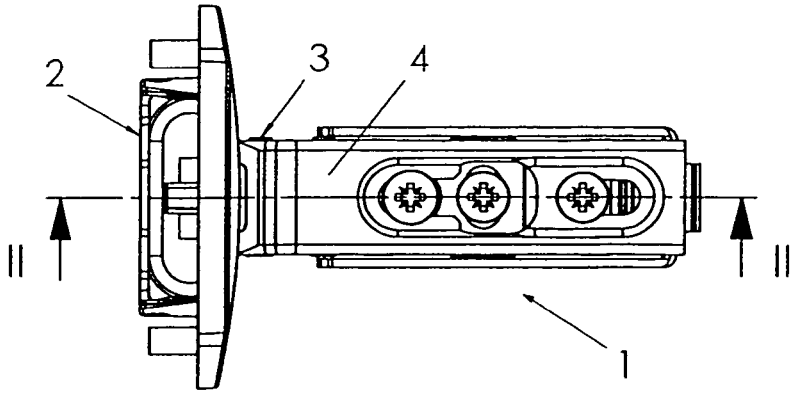
FIG. 1: a view from above of the invention-related cabinet hinge in the closed position.

The cabinet hinge (1) includes a hinge cup (2), which is connected by a hinge (3) with a hinge arm (4), which is connected to a base plate (5), which connects to the cabinet (not shown).

The hinge (3), placed between hinge cup (2) and hinge arm (4), includes a parallelogram joint, consists of an outer joint lever (8) and an inner joint lever (6), which are hinged swiveling with joint pins (9) and (7) on the hinge cup (2), as well as on the hinge arm (4).

Reference mark 10 refers to a vertically running pin, which is provided for other uses, e.g. for an opening spring as in DE 10152699 A1. However, neither this pin nor the spring laying on it, is necessary for the presented invention because the opening strength is provided by spring element (11) on/in the hinge cup (2). The presented invention can, of course, have an additional spring to spring element (11), which lays on pin (10) and which is used either as a support opening spring as is shown in DE 10152699 A1, or as an automatic self-closing, according to the current state of technology. The presented invention should, therefore, also embrace a combination of a spring element (11) inside a hinge cup (2) as an automatic opening device with a spring on pin (10) as a supporting automatic opening or as an automatic self-closing.

Figure 2:
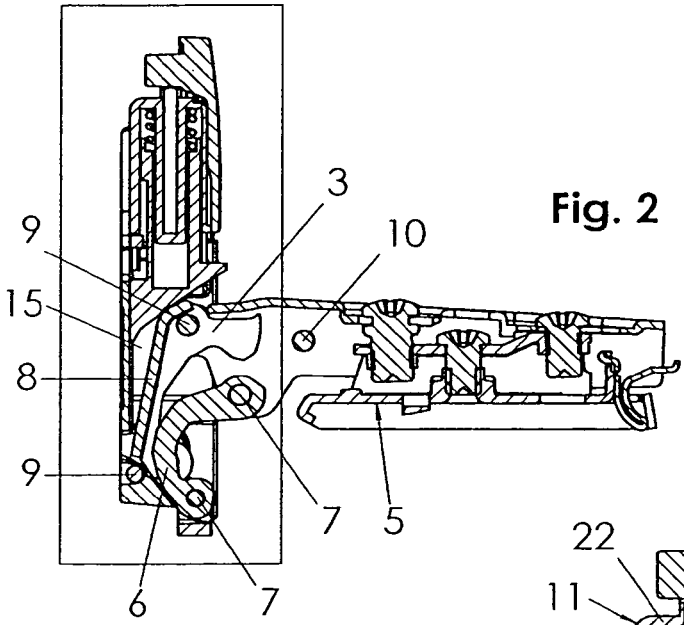
FIG. 2: a section view of the cabinet hinge in FIG. 1 along the cutting line II—II.
Figure 3:
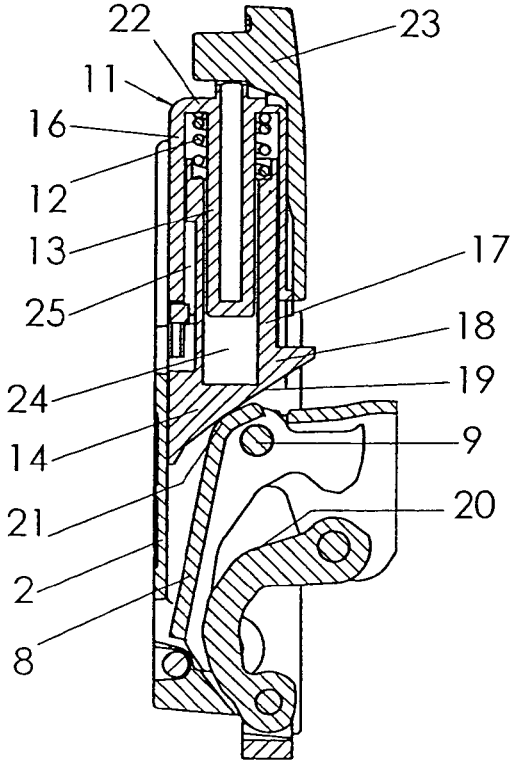
FIG. 3: an enlarged detailed view of FIG. 2; whereby, the hinge cup is shown with the spring element.

FIG. 1 to FIG. 3 show the cabinet hinge (1) in the closed position, i.e. when the cabinet door is fully closed, whereby, the cabinet door and the cabinet are not shown. The outer articulated joint lever (8) pressed onto the sliding wedge (14) and the spring element is pre-tensed. The cabinet hinge (1) keeps closed as long as the locking mechanism (not shown) is bolted shut.

FIG. 3 shows that the entire spring element (11) lays in the inner area (15) of the hinge cup (2), as well as the most of the joint levers (6 and 8).

The enlargement of FIG. 3 shows that the spring element (11) consists of a cup-like unit (16), which braces with its bottom (22) onto a cover part (23) of the hinge cup (2). Inside of the cup-like unit (16) is a guide element in the form of a piston rod (13), which is fastened approximately in the center of the bottom (22), and which serves on the one hand as an inside guide for the cylinder spring (12) above and on the other as a inside guide for the hollow cylinder-formed shaft (17) of the sliding wedge (14). The inside wall of the cup-like unit (16) serves as the outside guide for the shaft (17) of the sliding wedge (14) and can also serve as the outside guide for the spring (12).

The spring element (11) is basically, therefore, a telescopic movable cylinder-piston unit; whereby, naturally, the kinematic return should be placed under protection as well. The cylinder-piston layout of the piston rod (13), which engages into the inside area (24) of the shaft (17) of the sliding wedge (14), can also be reversed so that a piston rod is placed at the top (18) of the sliding wedge (14), which engages in a guide cylinder fastened to the hinge cup so that the spring (12) works in between the two parts.

If the shaft (17) of the sliding wedge (14) is formed as a piston rod, the guide element (13) is preferably omitted and the spring (12) is optionally located between these parts, the top of the wedge (18) and the cup-like unit (16).

The arrangement of the spring (12) is also optional and can be on the inside area (24) of the shaft (17) of the sliding wedge (14), or in the gap (25) between the inner lining of the cup unit (16) and the outer lining of the shaft (17) of the sliding wedge (14). It is always important in this case, though, that through the spring (12), a relative movement is possible between the sliding wedge (14) and the hinge cup (2).

It is necessary for the piston rod (13) to be hollow, because of the resulting under-pressure and/or over-pressure on the inside area (24) of the sliding wedge (14), since an overflow bore hole (not shown) in the piston rod (13) allows air to escape from the inside area (24) through this overflow bore hole into the atmosphere, or vice versa, air can flow into the inside area (24) through this overflow bore hole.

According to FIGS. 1–3, the spring (12) is in the pre-tensed position when the door is fully closed, so that the user does not have to expend any additional strength for the opening process.

The spring (12) is located then, according to FIGS. 1–3, pre-tensed between the bottom (22) and the lower front side of the shaft (17) of the sliding wedge (14) and is kept in position by a locking device that is not depicted; whereby, the wedge-shaped support surface (19) of the head (18) of the sliding wedge (14) is resting on the support surface (21) of the outer joint lever (8).

The wedge-shaped support surface (19) of the head (18) of the sliding wedge (14) can also rest on the support surface (20) of the inner joint lever (6).

The form of the support surface (19) of the head (18) of the sliding wedge (14) and the support surface (21) of the outer joint lever (8) are, of course, compatible in order to allow a predefined sliding on top of each other during the opening and closing of the cabinet door. In this manner, the strength of the pre-tense spring (12) and its linear movement of the wedge-shaped support surface (19) of the head (18) of the sliding wedge (14), and the support surface (21) of the outer joint lever (8), can be converted into torque of the door.

Figure 4:
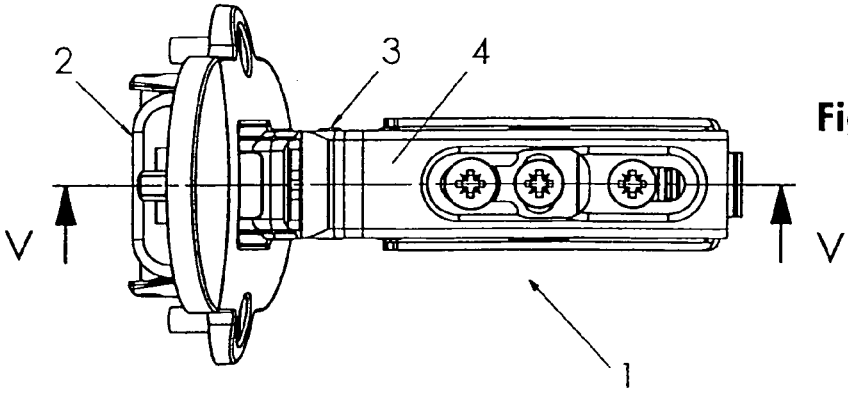
FIG. 4: the invention-related cabinet hinge viewed from above, with the opening mechanism at the maximal opening angle.
Figure 5:
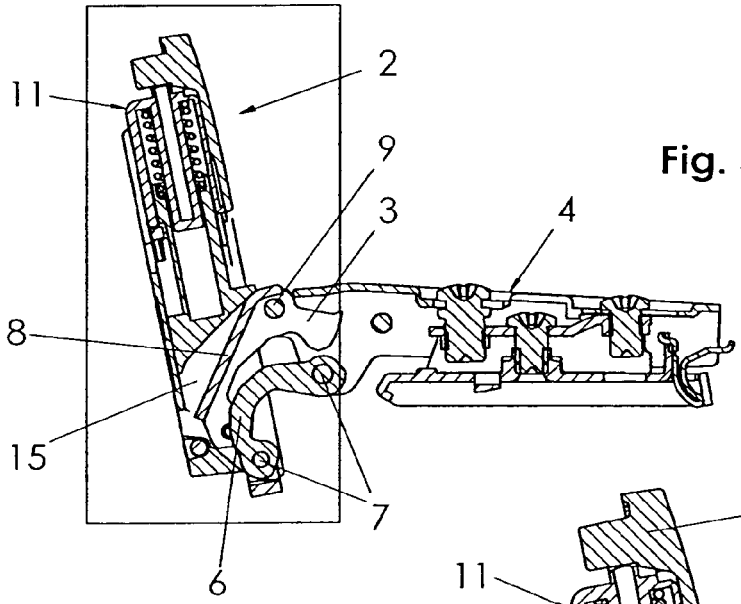
FIG. 5: a sectional view of the cabinet hinge according to FIG. 4, along cutting line V—V.
Figure 6:
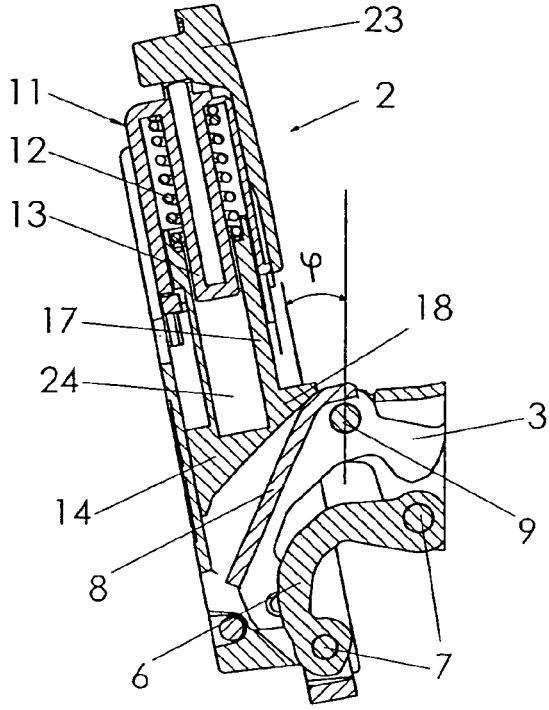
FIG. 6: an enlarged detailed view of FIG. 5, showing the hinge cup with spring element.
Figure 7:
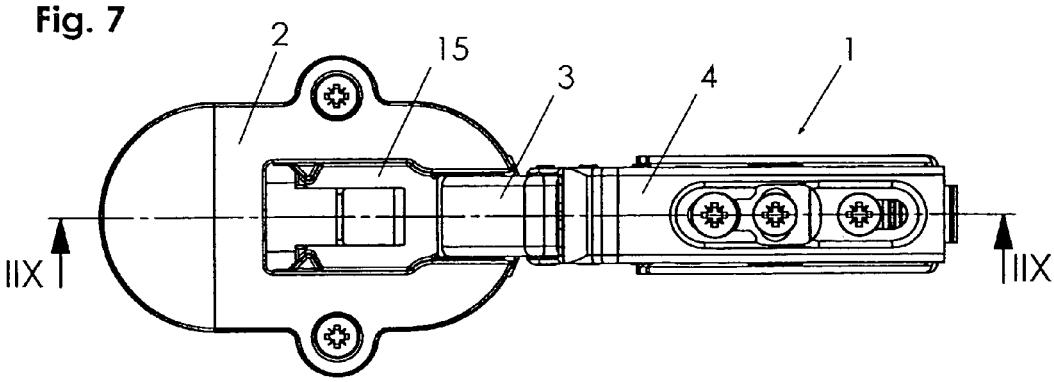
FIG. 7: view of the invention-related hinge from above, while totally open.
Figure 8:
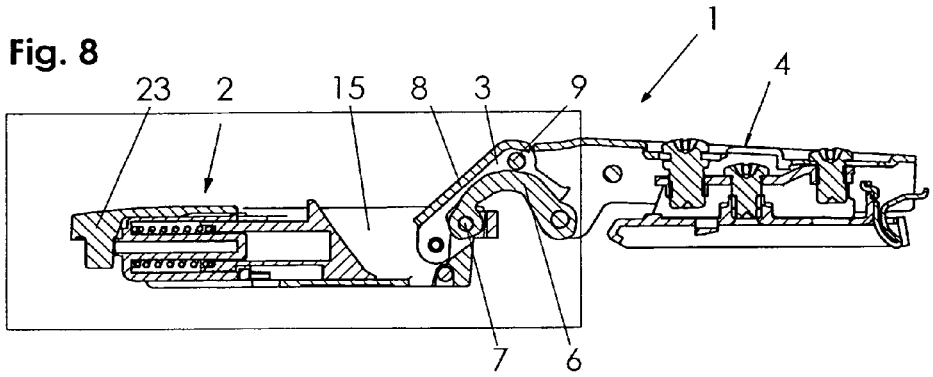
FIG. 8: a sectional view of the cabinet hinge, as shown in FIG. 7, along cutting lines IIX—IIX.
Figure 9:
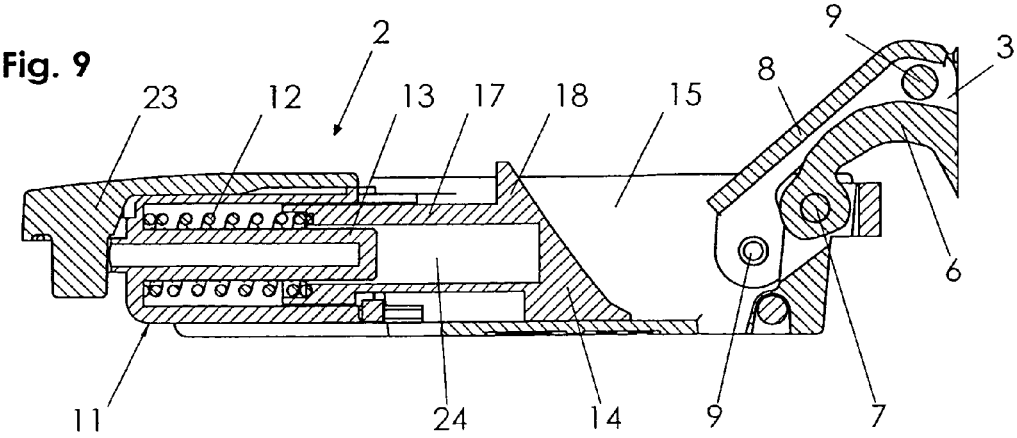
FIG. 9: an enlarged detailed view of FIG. 8, showing the hinge cup with spring element.

In FIG. 4 to FIG. 6 the locking mechanism (not shown) was unlocked and the spring element (11) released. This means that the sliding wedge (14) turns while pushing the outer joint lever (8) and the cabinet door opens automatically to a designated opening angle (position shown). This maximum opening angle $\phi$ is between 8° and 20° and here, in the example, is at approximate 12°. Preferably, the strength of spring (12) is only effective between minus 3° or 0° and plus 8° opening angle of the door (angle between the door plane and the plane of the front side of the cabinet) as it concerns the swing of the door. In FIG. 7 to FIG. 9 the cabinet hinge is shown in the open position, opened by the user. The spring element is without tension (same position as in FIG. 4 to FIG. 6) and the cabinet door was completely opened by the user, who opened the door from the maximum automatic opening angle $\phi$ of approximate 8°–20° provided by the invention-related automatic opening device, opened up manually up to an opening angle of e.g. between 90° and 180°.

DRAWING LEGEND

1. Cabinet hinge
2. Hinge cup
3. Hinge
4. Hinge arm
5. Base plate
6. Inside joint lever

7. Joint pin
8. Outside joint lever
9. Joint pin
10. Joint pin (without the usual spring)
11. Spring element/opening element
12. Compression spring
13. Pivot rod
14. Sliding wedge
15. Inside area of 2
16. Cup-like unit
17. Shaft of 14
18. Wedge head of 14
19. Support surface of 14
20. Support surface of 6
21. Support surface of 8
22. Bottom of 11
23. Cover part of 2
24. Inside area of 17
25. Gap between 13 and 17

ϕ maximum automatic opening angle of the cabinet door

The invention claimed is:

1. Cabinet hinge with automatic opening device for a cabinet door, comprising:

a hinge cup mountable on to a cabinet door and connected by a hinge joint to a hinge arm, the hinge arm being adjustably and securably connected to a base plate mountable on a cabinet;

wherein the hinge joint further comprises an inside joint lever and an outside joint lever, each being pivotally attached by a joint pin on the hinge cup, as well as the hinge arm;

wherein the inside joint lever and the outside joint lever together define a parallelogram-like joint between the hinge cup and the hinge arm, by which the hinge cup mountable on the cabinet door can be swung relative to the hinge arm connected to the base plate mountable to the cabinet between open and closed positions of the cabinet door relative to the cabinet;

at least one elastic spring-loaded spring element fastened to the hinge cup and urging a spring force that is transmitted via a sliding wedge to the joint pin of at least one of the outer joint lever and the inner joint lever, causing a torque for swinging the hinge cup mountable on the cabinet door from the closed position through a pre-defined opening angle area to the open position;

wherein the hinge cup has a cover part and the spring element further comprises at least one piston rod-cylinder unit moving the sliding wedge relative to the hinge cup and the cover part of the hinge cup during an opening phase of swinging the hinge cup mountable on the cabinet door from the closed position to the open position;

wherein the spring of the spring element is pre-tensioned with a stored potential energy when the door is in the closed position and releases the stored potential energy over the pre-defined opening angle area when the door is swinging toward the open position, and has no tension after the door swings through a pre-determined maximum opening angle (ϕ); and wherein the opening angle area is between approximately minus 3° to 0° and the maximum opening angle is approximately 20°.

2. Cabinet hinge with an automatic opening device, according to claim 1, wherein the spring element is placed at least partially in an inner area of the hinge cup.

3. Cabinet hinge with automatic opening device, according to claim 1, wherein the spring element further comprises a cup-like unit in which a piston rod is contained, and which is inserted within an inside area of a shaft of the sliding wedge, and a spring located between the cup-like unit and the sliding wedge that allows axial relative movement between the cup-like unit and the sliding wedge.

4. Cabinet hinge with automatic opening device, according to claim 1, wherein the spring element further comprises a cup-like unit, which contains a hollow cylinder that has a piston rod of the sliding wedge inserted in an inside area of a hollow cylinder of the sliding wedge, and a spring located between the cup-like unit and the sliding wedge that allows axial relative movement between the cup-like unit and the sliding wedge.

5. Cabinet hinge with automatic opening device, according to claim 1, wherein the spring element further comprises a cup-like unit with a piston rod of the sliding wedge inserted in an inside area of the sliding wedge, and a spring located between the cup-like unit and the sliding wedge that allows axial relative movement between the cup-like unit and the sliding wedge.

6. Cabinet hinge with automatic opening device, according to claim 1 wherein the sliding wedge further comprises a shaft formed in an end area of the sliding wedge and a wedge head formed in an opposite end area of the sliding wedge, which forms a wedge-shaped support surface for contacting a support surface of one of at least one of the outer joint lever and the inner joint lever.

7. Cabinet hinge with automatic opening device, according to claim 6, wherein the support surface of the sliding wedge conforms to the support surface of the at least one of the outer joint lever and the inner joint lever.

8. Cabinet hinge with automatic opening device, according to claim 7, wherein the support surface of the at least one of the outer joint lever and the inner joint lever further comprises two planar surface areas, which are connected to each other by a curved surface area, and the support surface of the wedge head of the sliding wedge is slideable on the support surface of the at least one of the outer joint lever and the inner joint lever.

9. Cabinet hinge with automatic opening device, according to claim 1, wherein the spring of the spring element produces a torque sufficient to swing the door through the opening angle area of between about minus 3° to 0° through an opening angle of approximately 8° of the door opening, without producing sufficient torque to swing the door opening between the opening angle of approximately 8° and the maximum opening angle of 20°.

10. Cabinet hinge with automatic opening device, according to claim 9, wherein the spring of the spring element has no tension after an opening angle of approximately 20° toward the open position of the door opening.

11. Cabinet hinge with automatic opening device, according to claim 10, wherein the spring of the spring element is one of a cylindrical coil compression spring made of one of steel and plastic, and an elastomer spring made of plastic.

12. A cabinet with automatic opening device for a cabinet door, comprising:

a hinge cup mountable on to a cabinet door and connected by a hinge joint to a hinge arm, the hinge arm being adjustably and securably connected to a base plate mountable on a cabinet;

wherein the hinge joint further comprises an inside joint lever and an outside joint lever, each being pivotally attached by a joint pin on the hinge cup, as well as the hinge arm;

wherein the inside joint lever and the outside joint lever together define a parallelogram-like joint between the hinge cup and the hinge arm, by which the hinge cup mountable on the cabinet door can be swung relative to the hinge arm connected to the base plate mountable to the cabinet between open and closed positions of the cabinet door relative to the cabinet;

at least one elastic spring-loaded spring element fastened to the hinge cup and urging a spring force that is transmitted via a sliding wedge to the joint pin of at least one of the outer joint lever and the inner joint lever, causing a torque for swinging the hinge cup mountable on the cabinet door from the closed position through a pre-defined opening angle area to the open position;

wherein the hinge cup has a cover part and the spring element further comprises at least one piston rod-cylinder unit moving the sliding wedge relative to the hinge cup and the cover part of the hinge cup during an opening phase of swinging the hinge cup mountable on the cabinet door from the closed position to the open position; and wherein the spring element further comprises a cup-like unit in which a piston rod is contained, and which is inserted within an inside area of a shaft of the sliding wedge, and a spring located between the cup-like unit and the sliding wedge that allows axial relative movement between the cup-like unit and the sliding wedge.

13. Cabinet hinge with automatic opening device for a cabinet door, comprising:

a hinge cup mountable on to a cabinet door and connected by a hinge joint to a hinge arm, the hinge arm being adjustably and securably connected to a base plate mountable on a cabinet;

wherein the hinge joint further comprises an inside joint lever and an outside joint lever, each being pivotally attached by a joint pin on the hinge cup, as well as the hinge arm;

wherein the inside joint lever and the outside joint lever together define a parallelogram-like joint between the hinge cup and the hinge arm, by which the hinge cup mountable on the cabinet door can be swung relative to the hinge arm connected to the base plate mountable to the cabinet between open and closed positions of the cabinet door relative to the cabinet;

at least one elastic spring-loaded spring element fastened to the hinge cup and urging a spring force that is transmitted via a sliding wedge to the joint pin of at least one of the outer joint lever and the inner joint lever, causing a torque for swinging the hinge cup mountable on the cabinet door from the closed position through a pre-defined opening angle area to the open position;

wherein the sliding wedge further comprises a shaft formed in an end area of the sliding wedge and a wedge head formed in on opposite end area of the sliding wedge, which forms a wedge-shaped support surface for contacting a support surface of one of at least one of the outer joint lever and the inner joint lever;

wherein the support surface of the sliding wedge conforms to the support surface of the at least one of the outer joint lever and the inner joint lever; and wherein the support surface of the at least one of the outer joint lever and the inner joint lever further comprises two planar surface areas, which are connected to each other by a curved surface area, and the support surface of the wedge head of the sliding wedge is slideable on the support surface of the at least one of the outer joint lever and the inner joint lever.

* * * * *